US005901524A

United States Patent [19]

Wright

[11] Patent Number: 5,901,524

[45] Date of Patent: May 11, 1999

[54] GRID-LIKE BUILDING PANEL FRAMEWORK AND MEMBERS FOR MAKING SUCH PANEL FRAMEWORK

[76] Inventor: Jerauld George Wright, 10, Wren Road, Gloucester, Ontario, Canada, K1J 7H4

[21] Appl. No.: 08/917,725

[22] Filed: Aug. 27, 1997

[51] Int. Cl.[6] ..... E04C 2/42

[52] U.S. Cl. ..... 52/668; 52/506.07; 52/660; 52/665; 52/730.7

[58] Field of Search ..... 52/506.07, 660, 52/664, 665, 666, 668, 730.7

[56] References Cited

U.S. PATENT DOCUMENTS

| | | | |
|---|---|---|---|
| 1,005,012 | 10/1911 | Forsyth | 52/668 X |
| 2,511,620 | 6/1950 | Clements . | |
| 3,300,936 | 1/1967 | Travaglia | 52/668 X |
| 3,768,224 | 10/1973 | Curtis . | |
| 4,409,770 | 10/1983 | Kawaguchi et al. . | |
| 4,671,032 | 6/1987 | Reynolds . | |
| 4,761,930 | 8/1988 | Tepera | 52/668 X |
| 4,765,105 | 8/1988 | Tissington et al. . | |
| 4,894,974 | 1/1990 | Mayhew et al. . | |
| 5,157,892 | 10/1992 | Ryther . | |
| 5,396,748 | 3/1995 | Rogers | 52/506.07 X |
| 5,617,700 | 4/1997 | Wright et al. . | |

*Primary Examiner*—Carl D. Friedman
*Assistant Examiner*—Kevin D. Wilkens
*Attorney, Agent, or Firm*—Jones, Tullar & Cooper, PC

[57] ABSTRACT

A framework type building panel, having opposed first and second sides, is formed of a plurality of primary and secondary structural members each of which has a web and a flange providing the member with a T-shaped cross-sectional shape; each member also has a series of transverse notches spaced along its web. The panel includes a first series the primary members which are spaced apart and parallel to each other with their flanges defining the first side of the panel, and a second series of the secondary members which are spaced apart and parallel to each other and extend transversely to the primary members and have their flanges defining the second side of the panel, with the webs of the primary members having their transverse notches of their webs engaging areas of opposed webs of the secondary members. The edges of the panel may also be formed by the primary or secondary members, rotated 90° about their axes, so that their webs extend inwardly and engage the ends of the other panel members. The primary and secondary members are preferably differentiated as to their strength.

14 Claims, 4 Drawing Sheets

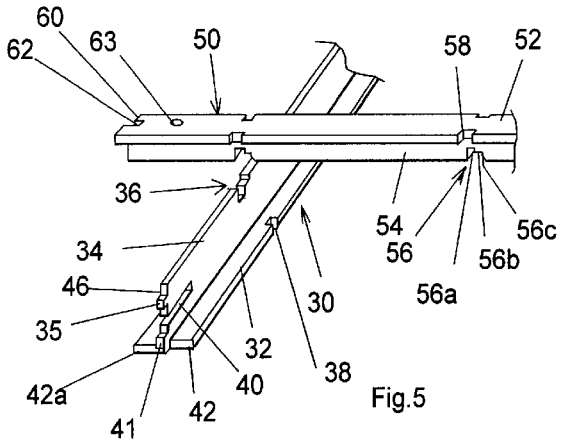
Fig.5
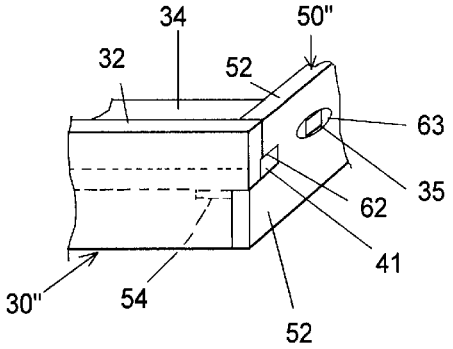
Fig.10
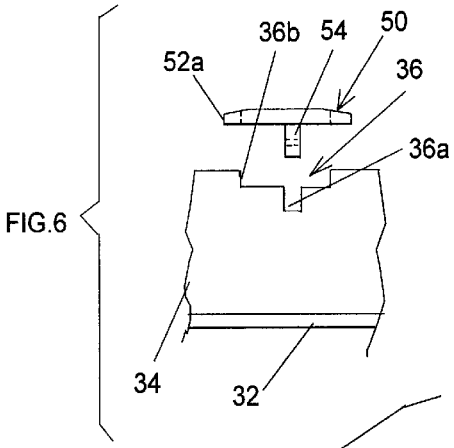
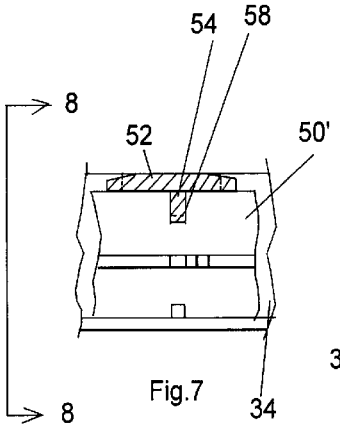
Fig.7
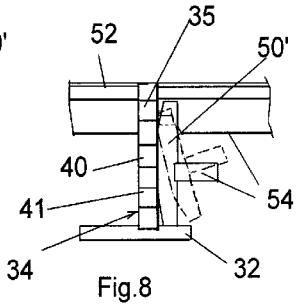
Fig.8
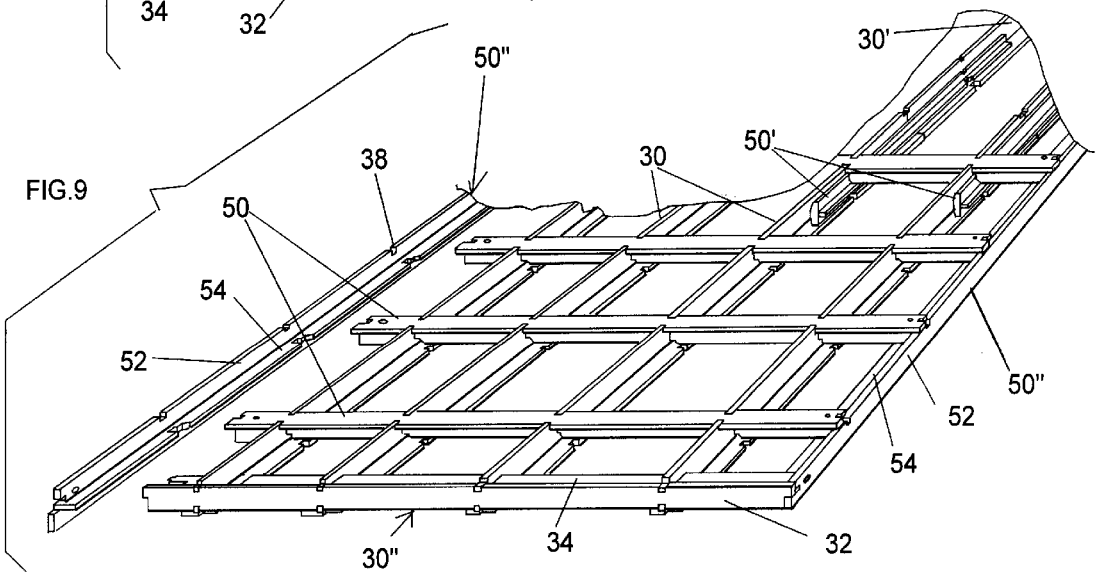

GRID-LIKE BUILDING PANEL FRAMEWORK AND MEMBERS FOR MAKING SUCH PANEL FRAMEWORK

BACKGROUND OF THE INVENTION

1. Field of the Invention

The present invention relates to building panels, particularly for the construction of houses. The invention is particularly concerned with a framework or skeleton panel which is formed as a grid of intersecting members, usually of wood-based material. The term "panel" will be used herein to include such a panel framework, and does not imply that this is a finished panel with insulation and/or facing sheets.

2. Prior Art

It is known to construct houses, and other buildings, from panels which are factory made, and which usually contain insulation. Examples of patents showing such panels are as follows:

U.S. Pat. No. 4,671,032, which issued Jun. 9, 1987 to Reynolds;

U.S. Pat. No. 4,765,105, which issued Aug. 23, 1988 to Tissington et al.;

U.S. Pat. No. 4,894,974, which issued Jan. 23, 1990 to Mayhew et al.

U.S. Pat. No. 5,157,892, issued Jun. 9, 1987 to Ryther; and

U.S. Pat. No. 5,167,700, issued Apr. 8, 1997 to Wright et al.

Applicant has had considerable experience both with the panels of the last-mentioned '700 patent, of which he is co-inventor, and with those of the Tisssington et al. patent. Both these patents are concerned with factory made panels having a framework made of wood members, and insulated with rigid foam insulation injected between the wood members in the factory. In the last-mentioned patent, dimensional lumber is used to provide strength, while in the Tissington et al patent it is preferred to use board such as oriented strand board (OSB). OSB is cheaper than standard dimensional lumber and is more resistant to warping. These panels have been used to construct over one thousand buildings of many different types, with great success.

Panels of the type shown in the Tisssington et al. patent and in the '700 patent have great potential in export markets, since buildings can be erected with these panels using largely unskilled labor. However, it has become apparent that a serious drawback of these and similar panels, i.e panels fully assembled and insulated in the factory, is that the bulkiness of the insulation leads to high shipping costs which are disadvantageous for export markets. The shipping costs could be much reduced if it were possible to ship a kit of structural members which could easily be assembled into a panel on site, without the need to ship the insulation.

The present invention accordingly is concerned with a panel in the form of a framework which can be shipped in disassembled form, without any insulation. The basic structural members of the panel occupy about one-fifth of the volume occupied by a fully assembled and insulated, factory produced panel. The structural members of the panel can easily be assembled on site by unskilled workers to form a rigid panel framework. Insulation, and facing sheets for example of plywood, OSB, and many other materials, can be added in accordance with local requirements and availability.

The present invention makes use of novel structural members which can easily be put together to form a grid.

Panels formed as grids of crossing, interlocking members, are not new per se, and the Mayhew and Ryther patents, as well as the '700 patent aforesaid, show such panels. However, the prior art panels have various drawbacks.

One drawback of many of the prior art designs is that the grid forming members, as for example in Mayhew et al. and Ryther, are too thin for their edges to reliably receive nails for the facing sheets.

Another drawback has been the need to use structural members additional to those of the basic panel itself. Firstly, such panels have generally needed some kind of rails or studs or side pieces to improve the appearance of any exposed edges of the panels, which otherwise show the ends of the lateral members. Such rails or studs are shown for example at 240 in FIG. 2 of Mayhew, and as 28 in FIG. 1 of Ryther. Secondly, the grid forming members in many cases have not been stiff enough to be used exclusively to form the panel; in Mayhew et al. the members 240 are in the nature of studs which add strength and stiffness. Accordingly, these prior constructions all require the use of members other than the basic grid forming members to complete the panel framework.

One special feature of this invention is that a panel framework can be entirely formed from a plurality of structural members of novel design, which can be all identical or can be of only two different designs. These basic members are used not only for the horizontal and vertical members of the panel grid, but also form its four edges, i.e. the side edges and end (e.g. top and bottom) edges of the panel, where they provide smooth relatively uninterrupted edge surfaces, while producing a panel of good strength and rigidity. The panel also has adequate nail receiving surfaces on both sides, even when formed of relatively thin material such as ¾ inch thick OSB. Insulation and facing sheets can be added after assembly.

Furthermore, the novel structural members can also be used to produce beams and joists needed for building a house, and also floor panels which need higher strength than the basic wall panels. In fact it is possible to construct houses almost entirely from panels, joists and other parts produced from these one or two types of structural member, along with facing sheets, and insulation if required, which can be obtained locally. This avoids the need to organise shipments of the many different structural members usually needed to make a house, and avoids problems which frequently occur if there is a shortage or breakage of one or two structural members of a specialized design.

SUMMARY OF THE INVENTION

In accordance with one aspect of the invention, a building panel framework, having opposite first and second sides, is formed of a plurality of primary and secondary structural members, each of which has a web and a flange providing the member with a T-shaped cross-sectional shape, and each of which has a series of transverse notches spaced along its web.

The panel includes a first series of the primary members which are spaced apart and parallel to each other with their flanges defining the first side of the panel, and a second series of the secondary members, usually cross members, spaced apart and parallel to each other and extending transversely to the members of the first series, and with their flanges defining the second side of the panel. The primary members have the transverse notches of their webs engaging areas of the opposing webs of the secondary members adjacent their transverse notches more specifically, between the transverse notches and flanges of the secondary members, so that the primary and secondary members form a grid with their flanges defining the opposite sides of the panel.

The use of T-shaped structural members means that each member has a flange on one side or the other of the panel and these flanges can readily receive nails, or other fixing means for facing sheets. Also, T shaped structural members are of course more rigid than the flat members used in the panels of Mayhew and Ryther, referred to above.

Another advantage of the use of T-shaped members is that, where the members have similar dimensions, they allow a double interlock to be made between the crossing members, which prevents unwanted twisting of the members. For this purpose notches in the webs of the members each have an inner, relatively narrow, portion for receiving part of the web of the crossing member, and an outer, relatively wide portion for receiving part of the flange of the crossing member, and the flanges of the members have opposed side notches which engage with parts of the web of the crossing member at the ends of the notch outer portions. Thus, each member engages another member not only at the web but also at the flange.

Yet another advantage of the use of T-shaped members is that these same members can also form edge members for the panel, and which present smooth, relatively uninterrupted edge surfaces. These the edge members are the same as other members making up the panel but are, in effect, rotated about their axes through 90° so as to have their flanges facing outwardly from the lateral edges of the panel and lying in planes perpendicular to the opposed first and second panel sides. These members thus have their webs projecting inwardly towards the center of the panel and disposed parallel to and between the opposed sides of the panel, the transverse notches of the inwardly facing webs being engaged with the ends of the webs of the members forming the grid. For this purpose the ends of the webs can be provided with longitudinal notches.

Preferably, each structural member has its web off-set from the center of its flange, such that one side of the web is at the center of the flange. This allows the edge members to include a first pair of edge members at opposite side edges of the panel having their webs nearer to the first side of the panel than the second side, and a second pair of edge members at opposite end edges, e.g. top and bottom edges, of the panel, the webs of the second pair being nearer to the second side of the panel than the first side, the webs of the second pair overlapping the webs of the first pair, and with the edges of the flanges of all the edge members being coplanar.

In a particular case, the panel of the invention is formed of a plurality of identical structural members, the primary and secondary structural members only differing in their orientation. This is obviously advantageous from a production point of view, and leads to minimum difficulty in assembly, and minimum supply problems with missing or broken members.

Having all the structural members identical is suitable where all or most of these are used to produce wall panels; it will be understood that there may be local reasons for using other members, perhaps available locally, for roofs or floors. However, if the structural members of this invention are also needed for roofs and floors, the use of identical members has the drawback that all have a relatively deep notch, about one half the depth of the web, and are therefore somewhat weak in bending. One solution to this problem is to combine the structural members with other such members, or with other local materials, to make suitably strong beams or roof or floor panels. However, a more satisfactory solution is to provide two distinct primary and secondary structural members, with the primary members (which will be the vertical members or props when used in a wall panel and will be the longitudinal members in a floor panel) having a large web with shallow notches and good strength, and the secondary members (the cross members in a wall or floor panel) having a narrower web and lesser strength. The notches in the primary member are preferably less than one-third the total height of the member, and in practice may be less than one-quarter the total height of the member. Either, or preferably both, members are used for the panel edges.

In order for the members which constitute the edge members to fit together, the ends of the edge member flanges are preferably rabbeted, i.e. formed with recesses so as to have end projections which can fit into the recess of an adjoining member. Also, the ends of the members may each have a peg which, when used as an edge member, engages in an aperture in the mating edge member.

BRIEF DESCRIPTION OF THE DRAWINGS

Preferred embodiments of the invention will now be described by way of example with reference to the accompanying drawings, in which;

FIG. 5 is a perspective partial view of primary and secondary types of members of different design which can be used to produce panels in accordance with the invention;

FIG. 6 is a side view of portions of the members shown in FIG. 5 before assembly;

FIG. 7 is a side view of a joint between the members of FIGS. 5 and 6, and incorporating a splice member;

FIG. 8 is a further view of the same joint, on lines 8—8 of FIG. 7;

FIG. 9 shows part of a panel framework constructed of the members shown in FIG. 5, with parts of an adjacent panel;

FIG. 10 is a fragmentary detail view of FIG. 9 of the joint between two edge members;

DETAILED DESCRIPTION

Figure 4:
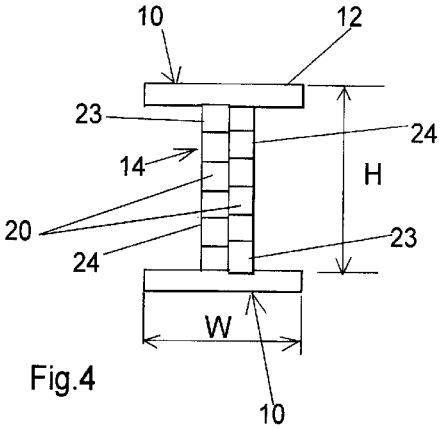
FIG. 4 is an end view of a beam formed of two structural members of FIG. 1.

The structural members 10, 10', 10" and 10'" shown in FIGS. 1 to 4, which are all identical, each comprises a flange 12 and a web 14 both formed of ¾ inch thick oriented strand board (OSB). The flange 12 has a width W (indicated in FIG. 4) of about 4 inches, and has a dado groove which receives the edge of the web; the web is dimensioned to give the member an overall height H of about 5½ inches. The web is off-set so that one of its sides is at the center of the flange, and so that the web of one member can be overlapped with and secured to the web of another member, as shown in FIG. 4, while the flanges of the two members have edges lying in common planes.

Figure 1:
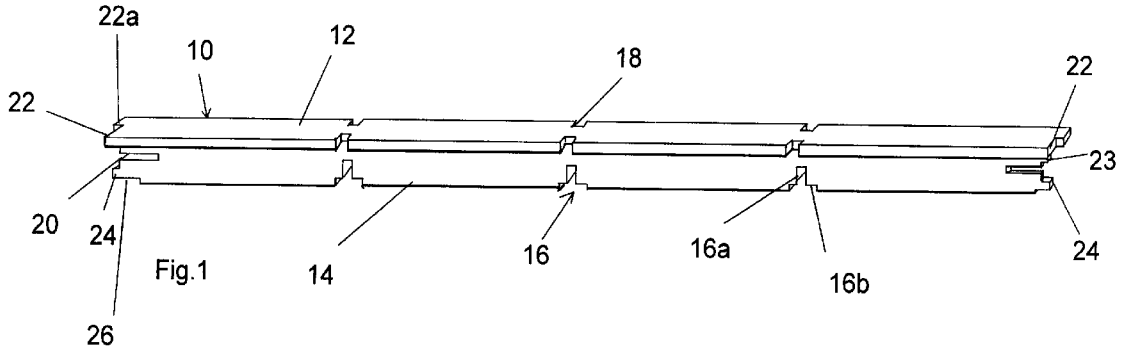
FIG. 1 shows a perspective view of one form of the novel structural member, which can be used with identical members to form a panel.
Figure 2:
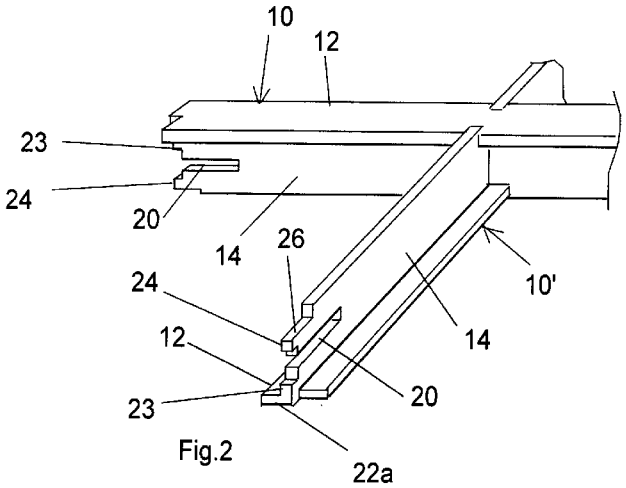
FIG. 2 is a perspective view of a joint between two of the structural members of FIG. 1.

The web 14 has notches 16 evenly spaced along its length; with the member having an overall length of 8 feet, the notches would be spaced on 2 foot centers. The notches each have an inner, relatively narrow portion 16*a* suitable for receiving the ¾ inch wide web 14 of an identical crossing member, indicated at 10' in FIG. 2, and each notch has an outer, relatively wide and shallow recess 16*b* for receiving part of the flange of the crossing member. At the same longitudinal locations along the structural members the flanges 12 are provided with small symmetrical notches 18 on their opposite sides, which are ¾ inches wide and ⅝ inches deep. The arrangement is such that, as shown in FIG. 2, two identical structural members can be fitted together, when extending perpendicularly to each other and with their webs opposed and flanges facing outwardly, a notch portion 16*a* of the first member web engaging opposite sides of the opposed web of the crossing member between one of its notches and its flange, and the recesses 16*b* of the first member web accommodating parts of the flange 12 of the second member between its notches 18. With this arrangement, the outer face of the flange of the first member is coplanar with the outer edge of the web of the second member, and vice versa. Also, the arrangement provides a double interlock between the two members, at the web and flange of each members, preventing twisting such as can occur with the usual single interlock shown in the prior art grid arrangements.

Figure 3:
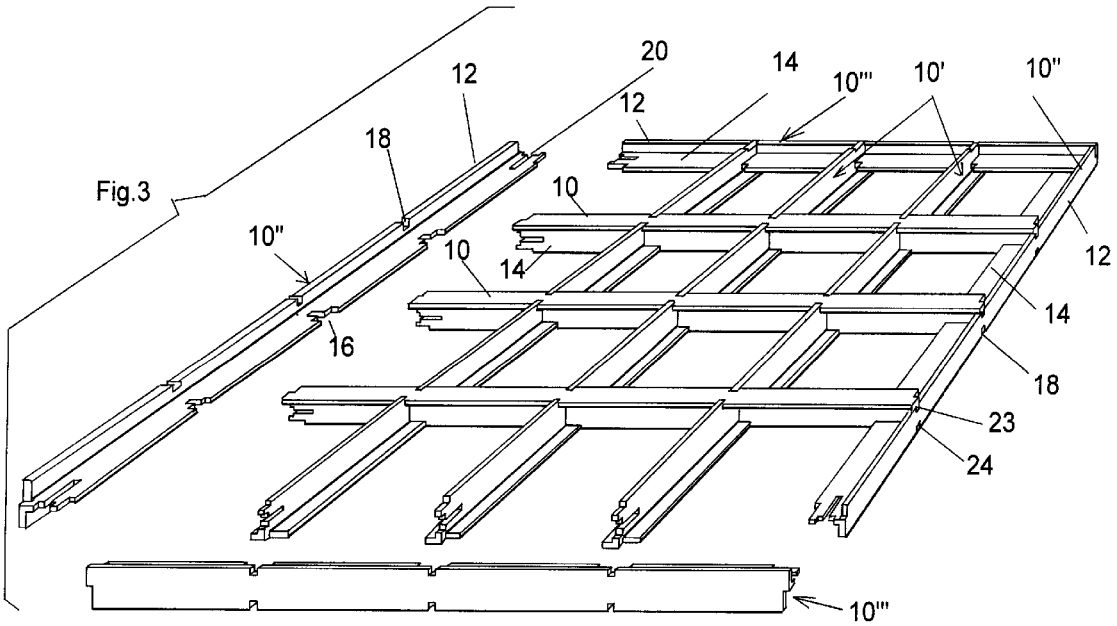
FIG. 3 shows a perspective view of a partly constructed panel formed of these members.

It will be seen with reference to FIG. 3 that a framework panel or grid of the members 10 can be built up in this way, having a first series of primary members 10 parallel to each other with their flanges 12 coplanar and effectively forming one side of the panel, and a second series of identical, secondary members 10' extending parallel to each other and perpendicular to the members of the first series, and with their flanges forming the second, opposite side of the panel, and with the outer edges of the webs of first type of member being co-planar with the flanges of the other type of members.

With the two series of members engaged as described, the ends of the members protrude from the sides of the panel. A unique feature of the grid or framework of this invention is that additional identical members 10", 10''' can be used as edge members to provide smooth, relatively uninterrupted edges to the panel. For this purpose the ends of the webs are provided with longitudinal notches or slots 20 of ¾ inch width and about 3½ inches deep, and the ends of the flange are formed with rabbets or recesses 22 leaving projecting end parts 22*a*. The projecting end parts 22*a* are associated with small projections 23 near the flange edges of the webs, and similar small projections 24 are formed near the outer edge of the webs. The slots 20 receive the areas of the webs of edge members 10", 10''' under their notches 16*a;* these members 10", 10''' are rotated 90° about their axes relative to the orientations of the other members so that their webs project inwardly, being parallel to the panel faces, and their flanges face outwardly of the panel edges and are orientated perpendicularly to the sides of the panel. The off-set nature of the webs allows one pair of opposite edge members 10" to have their webs nearer the first side than the second side, and the other edge members 10''' to have their webs nearer to the second side than the first side, while at the corners the two adjacent ends of the edge members 10", 10''' have their webs overlapping and in contact with each other while their flanges have coplanar edges. Also at the corners, the projecting end portions 22*a* of one edge member fit into the recess or rabbet of an adjoining member. The projecting end portions 22*a* of the members forming the grid extend over the flanges of the edge members, and can be fixed thereto, while the small projections 23 and 24 engage in the side notches 18 of the edge member flanges. The ends of the webs 14 also have recesses 26 formed in their outer corners, these being 1⅜ inch in length and ¾ inch in depth. When these members are used vertically in a wall panel, these recesses 26 can accommodate the notched portions of the flange of a further reinforcing member laid along the top of the panel.

The members may be held together with staples or glue, preferably both. Nails are preferably avoided in the construction of the framework, since there is often a need to cut into the members of a completed panel, for example to provide window openings. The assembled members provide a panel with good rigidity, even before facing sheets and nails are applied.

The panel framework can be finished by applying insulation, if needed, electrical wiring, and facing sheets or siding may be nailed onto the flanges on the opposed sides. The insulation may be batts fitted in between the members. The facing sheets may be material locally such as stucco grid or plywood sheets. Unlike in prior art patents showing grid construction, the facing sheets can be attached with nails, since these can be driven into the relatively wide flanges 12, and one does not have to rely on driving nails into the narrow edges of the OSB material.

The panel produced as described has a length and height of 8 feet. The formation of longer panels by joining similar members is discussed below.

FIG. 4 shows an end view of a joist, formed of two members 10 having their webs 14 held together side-by-side; this forms an I beam. It will be seen that the off-set nature of the webs is such that with the webs connected together, the edges of the flanges are co-planar. Stronger and more complex beams are described below.

The use of identical members is suitable for wall panels, and is obviously advantageous from a production point of view, and simplifies construction. However, in order for the edges of the webs of these members to be co-planar with the flanges of the crossing members, the webs are notched to one-half the member height (H), and this makes the panel undesirably weak for use as floor or roof panels. When this is desired, there are two ways of improving the bending strength of the members and panels formed therefrom, i.e.:

a) using identical members which have notches of less than one half their depth, so that in the assembled panel the flanges on each side of the panel stand out beyond the edges of the webs on that side; or b) using two types of members, both similar to the single type previously described in each having a flange and a web, with spaced notches in the web, but in which a series of primary members each have a large web and small notches, capable of providing good bending strength lengthwise of the panel, while secondary members each have a small web, also with small notches, and provides adequate strength for the lateral direction of the panel.

The latter form of the members, which is preferred, will now be described in relation to FIGS. 5 to 10 of the drawings.

As shown in FIG. 5 a primary structural member 30 has a flange 32 of 4 inches width, with a dado groove which receives a web 34 giving the member a total height of 5½ inches. As before, the web has one of its sides coincident with the center of the flange so that the webs of two members can lie side-by-side with the edges of their flanges aligned. The web 34 has notches 36, one of which is seen in FIG. 6, which are similar to notches 16, except that the narrow portions 36*a* of the notches are relatively shallow, being only 1⅜ inches in depth, i.e. less than one-quarter the total height of the member. The wider, shallower notch portions 36*b* are 2¾ inches wide and ¾ inches deep. The web 34 has end slots 40 similar to those of member 10, and which are 3½ inches deep. Also, the end of each web 34, between the notch 40 and the web outer edge, has a longitudinally projecting rectangular peg 35, and a recess 46 which serves the same purpose as recess 26 in the first embodiment. Also, spaced below the slot 40 is a projection 41 which is flush with a projecting end portion 42*a* of the flange 32; the other end portion 42 of the flange is recessed to form a rabbet. As before, the flange 32 has side notches 38, these being ⅝ inch in depth and ¾ inch in width.

The secondary member 50 shown in FIG. 5 is again similar to member 10, except in the form of its web and end formations. It has a flange 52 which is similar to that of the member 10, having the same side notches shown at 58, which are the same dimensions as notches 38. Its web 54 is much shallower than web 34, so that the total height of the member 50 is only 2 inches. The notches in the web 54 include a primary notch 56*a* of ¾ inch depth and ¾ inch width, adjoining an auxiliary notch 56*b* of ½ inch depth and ¾ inch width. The auxiliary notch has a chamfered side portion shown at 56*c*.

Another difference over the members 10 is that the outer surface of the flange 52 has chamfered outer surfaces 52*a* near its edges, as seen in FIGS. 6, 7 and 8.

As before, the ends of the flanges 52 of the secondary member have rabbets, shown at 60, but here the rabbet also has a notch 62, close to the side of the web, and further has a circular hole 63 longitudinally aligned with this notch. The notch 62 and hole 63 are positioned and sized to receive, respectively, the projection 41 and the peg 35 at the end of the primary member, when the two members are used as edge members and meet at a corner of the panel as shown in FIG. 10.

FIGS. 7 and 8 indicate how the joints between the primary and secondary members are formed, with the notched areas of the primary web 34 engaging the notched areas of the secondary web 54, and the side notches 58 of the flange 52 engaging the web 34 at the sides of the outer portions 36*b* of the notches. This construction can be used to build up a panel as shown in FIG. 9.

FIGS. 7 and 8 also show a further use of the secondary member 50; a short length, for example a 2 foot length, of such member 50' can be used as a splice for connecting two primary members end-to-end. As shown, the member 50' is fitted with the outer surface of its flange 52 lying against the webs 34 of the two connecting primary members, this being possible since the width of the flange 52 (about 4 inches) is the same or no wider than the width of the webs of the primary members 30, and fit within the space provided by the primary member web between its flange 32 and the flange 52 of the grid-forming secondary member 50. A notch 58 of the flange 52 of member 50' engages the web 54 of the member 50 at its auxiliary notch 56*b*. The member 50' is inserted by a tilting action, as indicated in broken lines, this being made possible by the chamfered outer surface of the flange 52 of the member 50' and the chamfered side 56*c* of the auxiliary notch of the grid-forming member 50. The member is secured to the web 34 to provide a splice connecting the primary members end-to-end. Preferably the member 50' is a snug fit between the opposed flanges 32 and 52.

FIG. 9 shows how the primary and secondary members are assembled into a floor panel, and indicate members 50' which can be used to connect the primary members of this panel to similar members, such as member 30', of another panel. The stronger primary members 30 are used longitudinally, and the secondary members 50 are used as cross members of the grid. At opposite sides of the each panel further secondary type members 50", rotated 90° about their axes, are used as edge members. Since the secondary members do not have end slots, the grid forming secondary members have the edges of their webs secured to sides of the webs of the edge members 50".

At the near end of the panel (as shown) the primary members 30 of the grid mate with a primary member 30" used as an edge member, having its web 34 engaging the slots 40 in the members 30, and with the pegs 35 and projections 41 at the ends of members 30 engaging the side notches 38 of the member 30". Also, as shown in FIG. 10, the pegs 35 and projections 41 at the ends of the member 30" fit into the notches 62 and hole 63 at the ends of the side edge members 50", with the web 34 of member 30" lying beside the webs 54 of the side edge members.

It is also possible to use four of the primary members 30 as edge members for a panel, but in this case it is necessary to cut off pegs 35 which cannot be accommodated by mating flanges.

The type of panel shown in FIG. 9 can also be a wall panel, in which case the primary members 30 will be used as vertical members, comparable to building studs. Apart from providing a panel which is better able to resist vertical forces than that of FIG. 4, the FIG. 9 panel also has the advantage that is easier to insulate. When an outer facing sheet has been applied to the flanges 32, insulation can be applied to the interior of the panel by being slid into the space behind the cross members 50; a clear space 3½ deep being provided behind these members.

Figure 11:
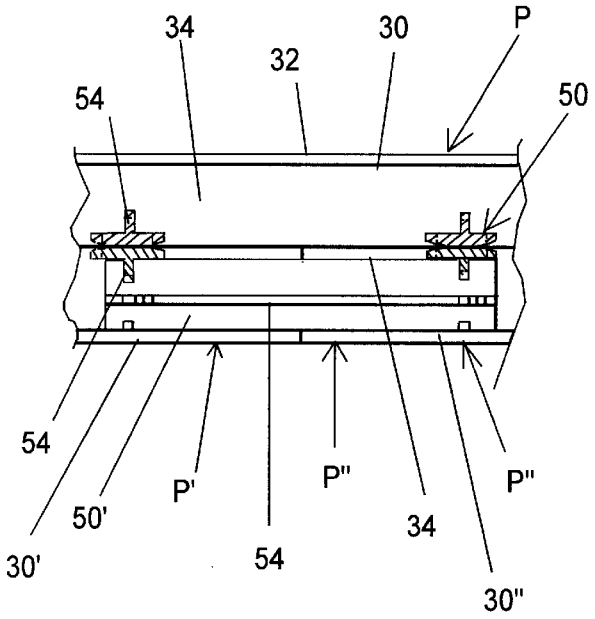
FIG. 11 shows the side view of parts of panel frameworks of FIG. 5, when incorporated into a floor panel.

FIG. 11 shows how the members shown in FIG. 5 can be used to buildup a strong, double thickness, floor panel. As shown, one upper panel P, similar to that of FIG. 9, is placed on top of the abutting end portions of two lower panels P' and P". The members 30 of the top panel overide and are aligned longitudinally with abutting end portions of members 30' and 30" of the lower panels, and members 30' and 30" are joined end-to-end by a portion of a secondary member 50' acting as a splice member, as in FIGS. 7, 8 and 9.

Thus, the joints in this floor panel only rely not only on splice members 50', but on an upper or lower panel part which is continuous above or below the joint. Using upper and lower staggered joints in this way allows a long floor of good strength to be produced.

It will be noted from FIG. 11 that the centerline spacing of the secondary members 50 at adjacent ends of the lower panels P' and P" is the same, namely 2 feet, as the spacing of the members of the upper panel P. The end portions of the grid forming members 30 and 50 are dimensioned so that this spacing is maintained whenever a panel is joined to another panel.

While FIG. 11 shows the primary members of the upper and lower panels aligned, this is not essential, and the primary members of the upper panel may be aligned with secondary members of the lower panel. This alignment gives some advantages in terms of the space for ducting which is provided in the combined panels, and in terms of the cross-wise stiffness.

Figure 12:
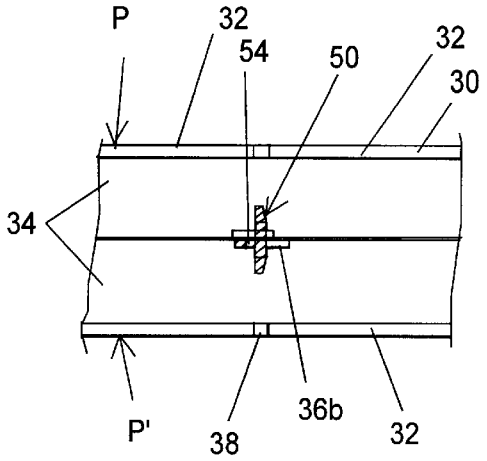
FIG. 12 is a view similar to FIG. 11 of an alternative joint construction between two floor panels.

FIG. 12 shows a floor construction having an upper panel P and a lower panel P', in which the primary members of the upper and lower panels are aligned, as in FIG. 11, but in which secondary members 50 are arranged to be shared between the two panels. In building up the lower panel P', the members 50 are rotated 90° about their axes from the usual orientation, and have their side notches 58 engaged with the notch portions 36*a* of the members 30', while the notched area of the web 54 of these members engages the sides of the webs 34 at the ends of the notch portions 36*b*. The upper primary member 30 also has its web 34 engaged with the side notches 58 of the members 50. This has the advantages of locking together the upper and lower primary members, and of providing additional bending strength in the cross-wise direction, while using only half the number of secondary members as compared to the FIG. 11 type construction.

Figure 13:
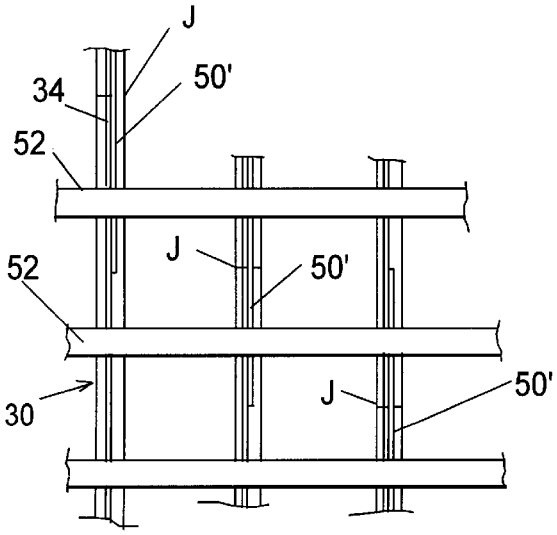
FIG. 13 shows a top view of portions of an alternative floor panel construction.

FIG. 13 shows another way that a long panel may be produced, particularly if this is to have only a single thickness, rather than the double thickness of FIGS. 11 and 12. As in FIG. 9, members 50' are used to produce joints between the abutting ends of members 30, but here the joints J are staggered across the panel so that each panel width has only one joint at each longitudinal location. As before, the dimensioning of the end portions of the members means that a 2 foot centerline spacing is maintained across the panel whether or not there is a joint.

FIGS. 14 to 18 show some of numerous beams and posts which can be produced using the members of this invention, and which have various uses in buildings.

Figure 14:
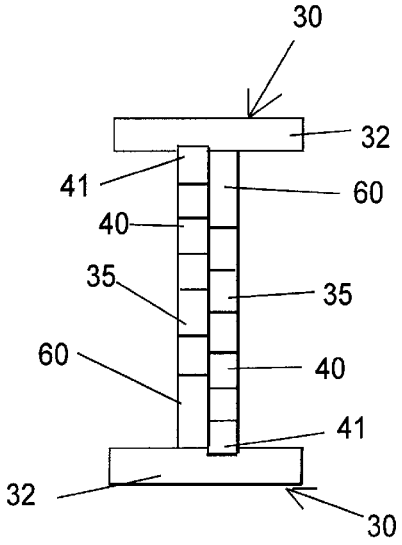
FIGS. 14 to 18 show end views and end portions of beams and posts formed using the structural members of this invention.

FIG. 14 is somewhat similar to FIG. 4, but has two of the members 30, rather than members 10, and uses these in association with flat strips 60 of OSB to give greater distance between the flanges 32, and therefore better bending strength.

Figure 15:
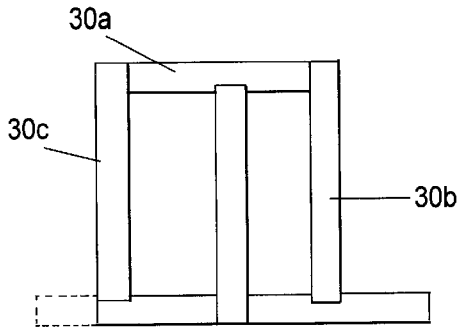
Figure 16:
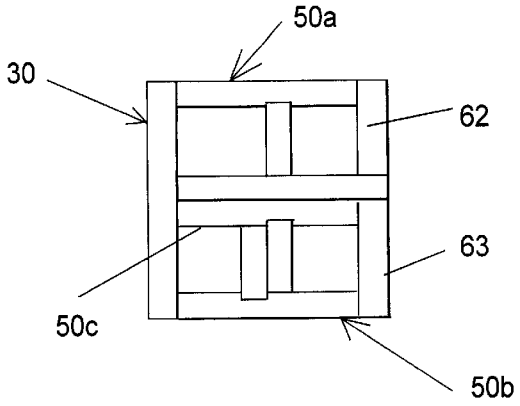

FIG. 15 shows a post formed of two complete primary members 30*a* and 30*b*, combined with the web and part of the flange of a third primary member 30*c*. The broken lines indicate the flange part of the member 30*c* which has been cut off. FIG. 16 shows a square post formed of one primary member 30, three secondary members 50*a*, 50*b*, and 50*c*, combined with two flat strips 62, 63, of OSB.

Figure 17:
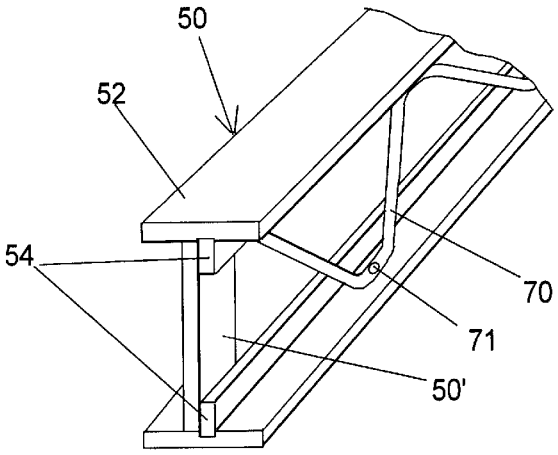
Figure 18:
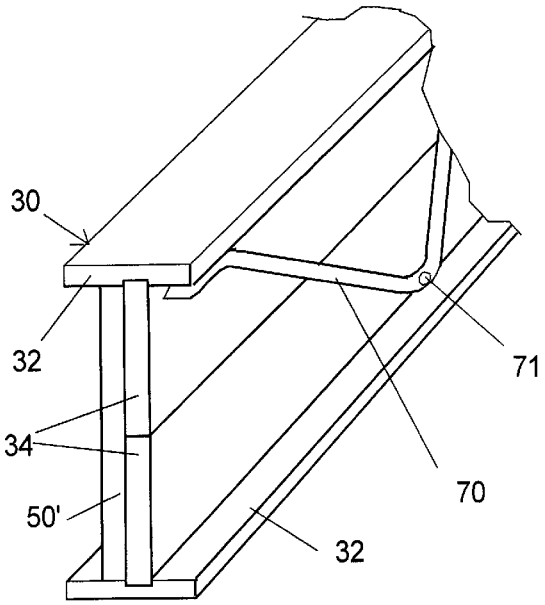

FIGS. 17 and 18 show beams which can be made using primary or secondary members 30 or 50, along with other parts including steel bracket parts 70. The latter may be similar to material available commercially for shelf brackets, and having a series of straight sections connected by right angle corners to produce a zig-zag configuration. As shown in FIG. 17, upper and lower secondary members 50 have their webs coplanar and projecting towards each other, and joined by short lengths of secondary members 50'. On one side of the webs there extends a steel zig-zag member 70 which has its corners fixed, as by screws 71, to the inner faces of the flanges 52. An even stronger beam is shown in FIG. 18, where two primary members 30 have abutting webs 34 joined by short lengths of secondary member 50' extending between their flanges 32, these flanges again being joined by attachment to the corners of the member 70.

I claim:

1. A framework type building panel, having opposed first and second sides, and formed of a plurality of primary and secondary structural members of wood based material, wherein each said structural member has a web and a flange connected to form a T-shaped cross-section, said flanges being suitable for receiving nails, each said member having a series of transverse notches spaced along its web, the panel including a first series of said primary members which are spaced apart and parallel to each other with their flanges defining the first side of the panel, and a second series of said secondary members which are spaced apart and parallel to each other and extend transversely to said primary members and have their flanges defining the second side of the panel, the primary member webs having their transverse notches engaging opposite side areas of opposed webs of the secondary members between the transverse notches and flanges of said secondary members, so that said primary and secondary members form a grid with their flanges defining the opposite sides of the panel.

2. A building panel according to claim 1, wherein said transverse notches of the web of each said primary member each has an inner, relatively narrow portion for receiving part of the web of a secondary member and an outer, relatively wide portion for receiving part of the flange of the secondary member, said flange of each secondary member having opposed side notches which engage with parts of the web of a primary member at the ends of said outer portion of a primary member notch.

3. A building panel according to claim 1, wherein the webs of the secondary members are less than one-half the depth of the webs of the primary members.

4. A building panel according to claim 3, wherein the notches in the webs of the primary members are less than one-third the overall height of the primary members.

5. A building panel according to claim 3, wherein the notches in the webs of the primary members are less than one-quarter the overall height of the primary members.

6. A building panel according to claim 1, wherein the flanges of said secondary members are no wider than the width of the webs of the primary members, and wherein additional ones of said secondary members are located with their flanges lying against the webs of the primary members for reinforcing the latter webs or for joining said primary members end-to-end with primary members of an adjacent panel.

7. A building panel according to claim 6, wherein the webs of the secondary members have an auxiliary notch adjoining each of said transverse notches for receiving notched areas of the flanges of said additional secondary members, said flanges of said additional members having a width allowing these latter flanges to be a close fit between the flanges of the primary and secondary members.

8. A building panel according to claim 1, wherein said panel also includes additional ones of said primary or secondary structural members which provide edge members for the panel, said edge members having their flanges facing outwardly and lying in planes perpendicular to said panel sides, the edge members having their webs projecting inwardly towards the center of the panel and disposed parallel to and between said sides, the inwardly facing webs being engaged with the ends of the webs of the members forming the grid.

9. A building panel according to claim 8, wherein at least the primary members each have longitudinal slots in the ends of their webs, which longitudinal slots receive the inwardly projecting webs of edge members.

10. A building panel according to claim 8, wherein each edge member has its web off-set from the center of said flange, said edge members including a first pair of edge members at opposite side edges of the panel having their webs nearer to the first side of the panel than the second side, and a second pair of said edge members at opposite end edges of the panel, the webs of said second pair being nearer to the second side of the panel than said first side, the webs of the second pair lying against the webs of the first pair while side edges of the flanges of all the edge members are coplanar.

11. A building panel formed of a plurality of substantially identical structural members and having opposite first and second sides, wherein each said structural member has a web and a flange connected to form a T-shaped cross-section, and wherein each said member has a series of transverse notches spaced along its web and also has a further, longitudinal, slot at the each end of its web, the panel including a first series of said members spaced apart and parallel to each other with their flanges defining the first side of the panel, and a second series of said members spaced apart and parallel to each other and extending transversely to the members of the first series and with their flanges defining the second side of the panel, the members of the first series having the transverse notches of their webs engaging opposite side areas of the opposed webs of members of the second series between the transverse notches and the flanges of the webs of the second series members, so that said members of the first and second series form a grid with their flanges defining the sides of the panel, the panel also including additional ones of said identical members providing edge members for the panel, said edge members having their flanges facing outwardly and lying in planes perpendicular to the panel faces, the edge members having their webs facing inwardly towards the center of the panel and disposed between the said first and second sides of the panel, the transverse notches of said inwardly facing webs being engaged with the ends of the webs of members forming said grid adjacent their longitudinal slots.

12. A building panel according to claim 11, wherein said transverse notches of the web of each said member each has an inner, relatively narrow, portion for receiving part of the opposed web of a second, transversely extending member, and has an outer, relatively wide portion for receiving part of the flange of the second member, and wherein said flanges of the members have opposed side notches which engage with parts of the webs of transversely extending members at the ends of said notch outer portions.

13. A structural member capable of being combined with a plurality of similar structural members to form a building panel, comprising a web and a flange connected to form a T-shaped cross-section, said web being off-set from the center of the flange so that the webs of two of said members can be joined together side-by-side with the edges of their flanges lying in common planes, said member having a series of transverse notches in its web suitable for receiving similarly notched areas of the webs of similar, transversely extending members, and each end of said web also having a longitudinal slot for receiving a notched area of the web of another said similar member which forms an edge member and has its flange lying in a plane perpendicular to the flange of said first mentioned member.

14. A structural member according to claim 13, wherein said transverse notches in said web each include a relatively narrow inner slot portion for receiving the web of the transversely extending member, and a relatively wide outer portion for receiving at least a part of the flange of the transversely extending member.

* * * * *